United States Patent [19]

Kaneko et al.

[11] Patent Number: 4,564,961

[45] Date of Patent: Jan. 21, 1986

[54] APPLIANCE FOR WASHING PARTS OF HUMAN BODY

[75] Inventors: Kenichi Kaneko, Kariya; Yuji Hirashiba; Shinji Kawai, both of Toyota, all of Japan

[73] Assignee: Aisin Seiki Co., Ltd., Kariya, Japan

[21] Appl. No.: 591,493

[22] Filed: Mar. 20, 1984

[30] Foreign Application Priority Data

| | | | |
|---|---|---|---|
| Mar. 29, 1983 | [JP] | Japan | 58-53027 |
| Mar. 29, 1983 | [JP] | Japan | 58-45379[U] |
| Mar. 29, 1983 | [JP] | Japan | 58-45380[U] |

[51] Int. Cl.[4] ..... E03D 9/08

[52] U.S. Cl. ..... 4/443; 4/420.5

[58] Field of Search ..... 4/443–448, 4/420.1, 420.2, 420.3, 420.4, 420.5, 615–617; 239/451, 538, 562, 581

[56] References Cited

U.S. PATENT DOCUMENTS

| | | | |
|---|---|---|---|
| 1,935,201 | 11/1933 | Callejo | 4/448 |
| 2,872,687 | 2/1959 | Maurer | 4/420.2 |
| 3,808,608 | 5/1974 | Caplan | 4/448 |
| 4,094,018 | 6/1978 | Bemthin | 4/447 X |
| 4,136,407 | 1/1979 | Maurer | 4/448 |
| 4,197,594 | 4/1980 | Butterfield | 4/448 |
| 4,304,016 | 12/1981 | Oguma et al. | 4/420.2 |
| 4,327,451 | 5/1982 | Baus | 4/420.2 |
| 4,411,030 | 10/1983 | Kawai et al. | 4/443 |

*Primary Examiner*—Stephen Marcus
*Assistant Examiner*—Leo James Peters
*Attorney, Agent, or Firm*—Oblon, Fisher, Spivak, McClelland & Maier

[57] ABSTRACT

An appliance for washing the posterior parts of the human body with water is equipped with an outer nozzle and an inner nozzle that is rotatable inside the outer nozzle. The outer nozzle is provided with holes, while the inner nozzle is formed with a plurality of sets of holes. Any desired one set of the sets of holes in the inner nozzle can be brought into registry with the holes in the outer nozzle by rotating the inner nozzle, whereby the area through which washing water is spurted can be varied.

7 Claims, 8 Drawing Figures

APPLIANCE FOR WASHING PARTS OF HUMAN BODY

BACKGROUND OF THE INVENTION

1. Field of the Invention

The present invention relates to an appliance for washing the posterior parts of the human body and, more particularly, to the nozzle structure of such an appliance.

2. Discussion of the Background

In conventional appliances for washing the posterior parts of the human body, as exemplified in U.S. Pat. No. 2,872,687, washing water is gushed after a spray head has been pushed to the washing position. Since the spray head is provided with only a given number of holes, the quantity of water poured out of these holes is constant. Hence, the user is unable to clean oneself according to his or her desire.

SUMMARY OF THE INVENTION

Accordingly, it is an object of the present invention to provide an appliance which is used to wash the posterior parts of the human body and which is free of the foregoing difficulties.

This object is achieved in accordance with the teachings of the present invention by providing a human body portion-washing appliance which includes an outer nozzle provided with holes and an inner nozzle provided with some sets of holes, any one set of which can be brought into registry with the holes in the outer nozzle.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENT

Figure 1:
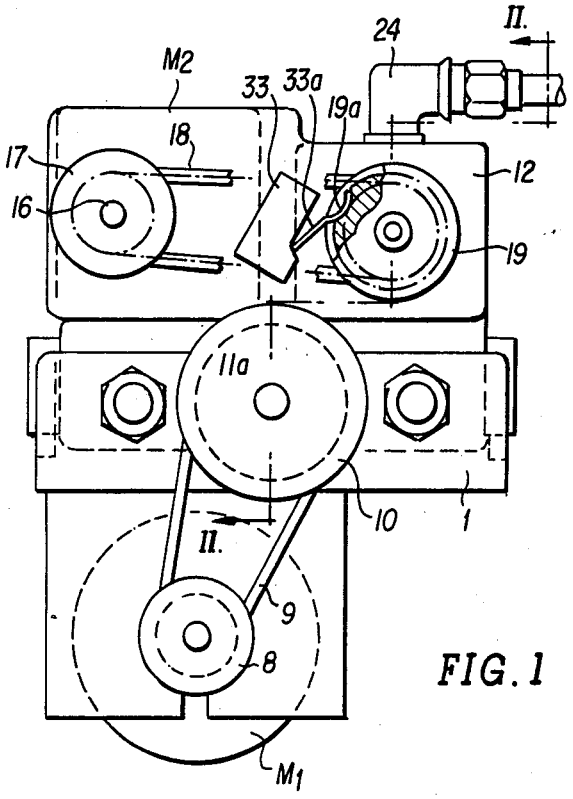
FIG. 1 is a side elevational view of an appliance according to the present invention.
Figure 2:
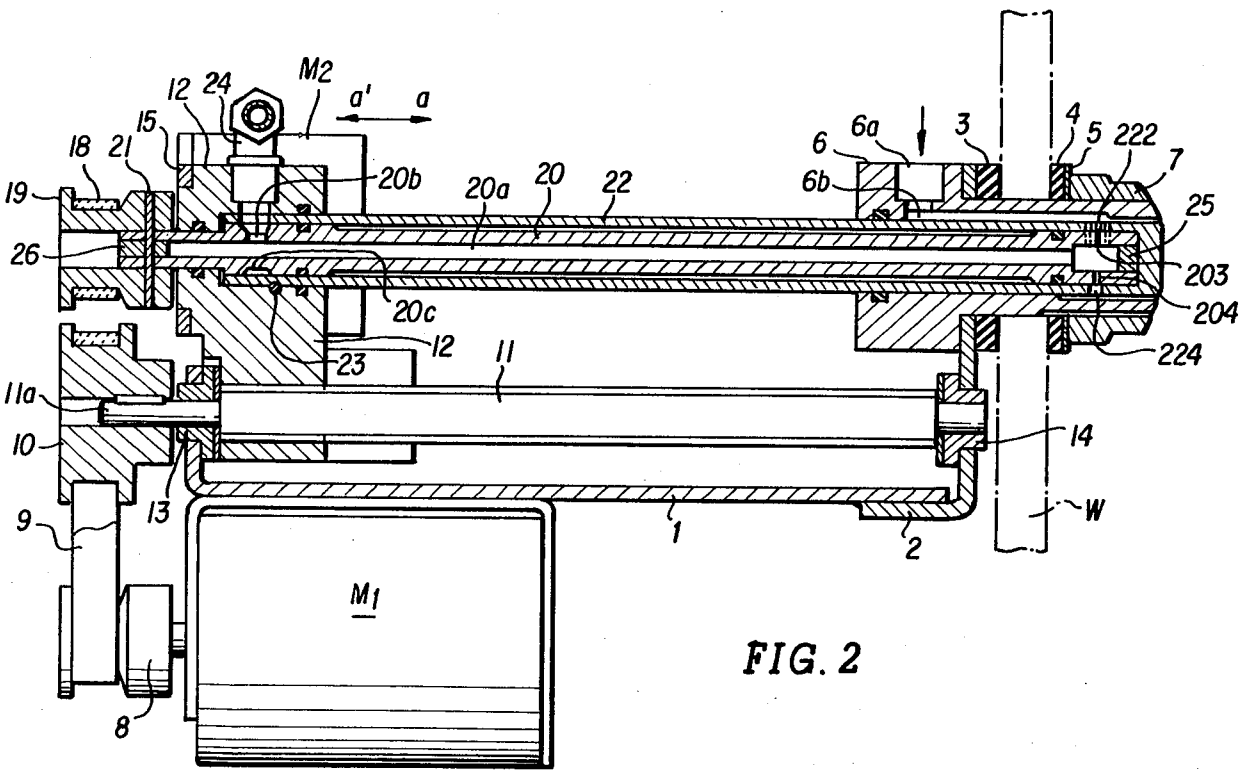
FIG. 2 is a cross-sectional view taken along line II—II of FIG. 1.
Figure 4:
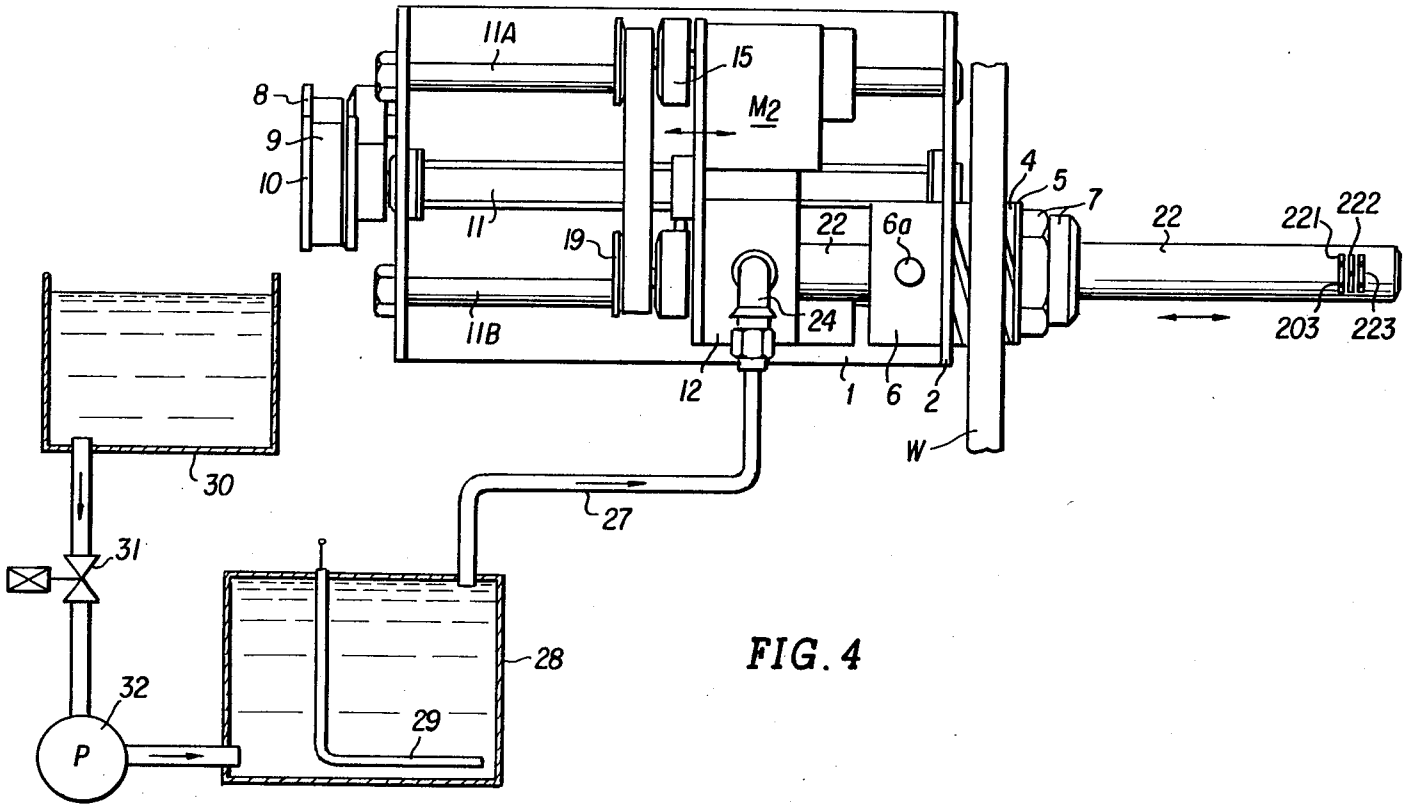
FIG. 4 is a plan view corresponding to FIG. 2 and also showing means for supplying washing water.

Referring to FIGS. 1, 2 and 4, there is shown an appliance for washing the posterior parts of the human body, the appliance being fabricated according to the concept of the present invention. This appliance includes a fixed frame 1 which is fixedly secured to a toilet bowl wall W by means of a nut 7 via another fixed frame 2, rubber spacers 3, 4, a washer 5, and a nozzle guide 6. Firmly secured to the underside of the frame 1 is a stepper motor $M_1$ which can rotate in opposite directions. The power created by the motor $M_1$ is transmitted to an upper pulley 10 via another pulley 8 and a belt 9. The pulley 10 is fixed to one end 11*a* of a threaded rod 11 into which a movable member 12 is screwed. When the pulley 10 turns, the rod 11 is also rotated. This moves the member 12 in the axial direction of the rod 11 indicated by the arrow a or a' (FIG. 2). To make this axial movement of the member 12 smooth, two guide rods 11A and 11B (FIG. 4) having their both ends secured to the fixed frames 1 and 2 guide the member 12. The opposite ends of the threaded rod 11 are rotatably held to the frames 1 and 2, respectively, via bearing members 13 and 14, respectively.

A second stepper motor $M_2$ is fixedly secured to a frame 15 which is anchored to the movable member 12. The motor $M_2$ has a shaft 16 (FIG. 1) to which a pulley 17 is fixedly mounted to transmit the power to another pulley 19 via a belt 18. The pulley 19 is secured by a set pin 21 to the rear end of an inner nozzle 20 which is mounted so as to extend through the movable member 12. Therefore, when the pulley 19 is rotated in one direction or the other, the nozzle 20 is rotated in the same direction.

Mounted around the outer periphery of the inner nozzle 20 is an outer nozzle 22 which does not turn. The aforementioned nozzle guide 6 is centrally provided with a hole which extends through it, and the outer peripheral portion of the nozzle 22 is fitted into this hole. When the movable member 12 is moved forward or backward (in the direction indicated by the arrow a or a'), the outer nozzle 22 is moved together with the inner nozzle 20 while guided by the guide 6. The rear end of the outer nozzle 22 is fitted into the movable member 12 and is joined by a pin 23 to the member 12. The inner nozzle 20 is centrally formed with an axial fluid passage 20*a*. The nozzle 20 is also provided with a radial groove 20*b*. An annular groove 20*c* is formed in the outer periphery of the nozzle 20. A nipple 24 is mounted outside the appliance to mount a conduit (not shown). The rear end of the passage 20*a* communicates with the passage within the nipple 24 via the grooves 20*b* and 20*c*.

Figure 5A:
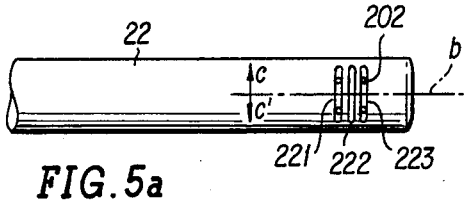
FIG. 5 is a fragmentary plan view of the front end of the outer nozzle in the appliance shown in FIG. 1.
Figure 5B:
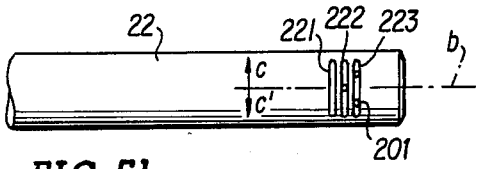
Figure 3A:
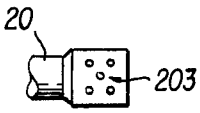
FIG. 3 is a fragmentary plan view of the front end of the inner nozzle in the appliance shown in FIG. 1.
Figure 3B:
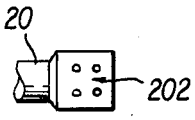
Figure 3C:
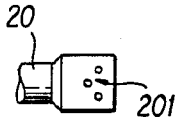

Plugs 25 and 26 are squeezed into the front and rear ends, respectively, of the inner nozzle 20. Three small holes 201, four small holes 202, and five small holes 203 are formed in the outer periphery of the front end at three positions spaced apart equally, as shown in FIG. 3. Three long holes 221, 222 and 223 are formed in the outer periphery of the front end of the outer nozzle 22 perpendicularly to the axis and extend circumferentially in parallel relation to each other, as shown in FIG. 4. It is to be noted that the three positions are not necessarily required to be spaced apart equally in the present invention. Since the outer nozzle 22 does not rotate but can move axially (forward or backward), when the inner nozzle 20 moves back or forth together with the outer nozzle 22 and rotates about its axis, the five holes 203 come into registry with the long holes 221, 222 and 223, as shown in FIG. 4, or the four holes 202 or the three holes 201 come into registry with the holes 221–223, as shown in FIG. 5 (*a*) and (*b*). Under the condition of such registry, when water is guided into the inner nozzle 20 under a certain pressure, washing water gushes upwardly from one set of the holes 201, 202 and 203. A hole 6*a* (FIG. 2) formed in the upper portion of the guide 6 and a passage 6*b*, which extends from front to back and is in communication with the hole 6*a*, act to wash away the filth adhering to the outer periphery of the outer nozzle, especially the front end, by causing washing water to flow in the direction indicated by the arrow of FIG. 2.

As also shown in FIG. 2, a single small discharge hole 204 is formed opposite to the five holes 203 in the inner nozzle 20. A similar small discharge hole 224 is formed opposite to the long holes 221–223 in the outer nozzle 22. The small holes 204 and 224 are so designed that whenever the nozzles 20 and 22 are withdrawn to the rearmost position as shown in FIG. 2, their axes coincide with each other as shown. More specifically, the rotational frequency of the stepper motor $M_2$ is so controlled that the inner nozzle 20 is brought into the shown position. The discharge holes 204 and 224 are provided to prevent washing water from remaining within the passage 20*a* after usage of this appliance, otherwise the next user would encounter with an unpleasant spurt of cold water.

The plan view of FIG. 4 corresponding to FIG. 2 shows means for guiding washing water into the passage 20*a* in the inner nozzle 20. In particular, a conduit 27 has one end connected to the above-described nipple 24, the other end being connected to the top of a warm-water tank 28, in which a heater 29 is installed to warm the water in it. Water is supplied from a feed water tank 30 to the bottom of the tank 28 through a solenoid valve 31 and a pump 32. The valve 31 is closed to prevent washing water from leaking away and dropping from the front ends of the nozzles 20 and 22 when the present appliance is not in use.

Referring back to FIG. 1, a microswitch 33 is disposed in close proximity to the pulley 19. The outer periphery of the pulley 19 is provided with a notch 19*a* with which the front end of a contact element 33*a* extending from the switch 33 engages. Thus, it is possible to detect the central point among the long holes 221–223 in the outer nozzle 22, more specifically, the line b passing through the centers of the holes 221–223 when viewed from above as shown in FIG. 5, by controlling the rotational frequency of the motor $M_2$. By rotating the inner nozzle 20 through a minute angle forwardly or backwardly about the aforementioned central point, the three holes 201, the four holes 202, or the five holes 203 are rotated very slightly in the direction indicated by the arrow c or c′ within the length of the long holes 221–223. Although stepper motors are used as the motors $M_1$ and $M_2$ in this embodiment, other conventional motors may also be employed as long as their rotational frequency can be controlled.

In the operation of the novel appliance constructed as thus far described, after the completion of the defecation of the user, a washing switch (not shown) installed on the appliance is depressed. Then, the motor $M_1$ turns to rotate the threaded rod 11, moving the movable member 12 a certain distance forwardly (in the direction indicated by the arrow a) from the rearmost position shown in FIG. 2. Thus, the inner nozzle 20 and the outer nozzle 22 are caused to assume their washing positions. The certain distance is determined by sensing the position at which the user is seated. Since the motor $M_1$ is a stepper motor, it can automatically be stopped after a certain rotation and hence the movable member 12 can be halted after it is traveled the aforementioned certain distance, which can be appropriately reset to another value by controlling the rotational frequency of the motor.

Under the condition of the washing positions (or before the nozzles assume these positions), another switch (not shown) is depressed to start the motor $M_2$, which then rotates the inner nozzle 20 about its axis, so that any one set of the three holes 201, the four holes 202, and the five holes 203 registers with the long holes 221–223. That is, the user can automatically select any desired one set from the holes 201, 202 and 203, and therefore the quantity of spurted washing water and the area through which the water is spurted, or area of washing, can be adjusted. It is also possible to manually select a desired set of holes instead of the automatic selection.

Just when the motor $M_2$ is started, the pump 32 begins to operate. At the same time, the solenoid valve 31 is opened, thus allowing warm water to be fed into the passage 20*a* in the inner nozzle 20 under pressure. Therefore, when any one set of the holes 201, 202 and 203 comes into registry with the long holes 221–223, the warm water is spurted.

When the motor $M_2$ rotates through a certain angle, a timer (not shown) acts to reverse the motors $M_1$ and $M_2$. Then, the nozzles 20 and 22 are restored to the rearmost positions shown in FIG. 2.

Where the appliance is to be used as a bidet, the user depresses a bidet switch (not shown). Then, the nozzles 20 and 22 are moved a distance of approximately 4 cm to their bidet positions forwardly from the washing positions. Thereafter, the inner nozzle 20 is rotated to select desired one set from the holes 201, 202 and 203 in the same manner as the foregoing washing operation. Thus, the genitals are washed with a desired quantity of spurted water and a desired area of washing.

While a preferred embodiment of the invention has been described using specific terms, such description is for illustrative purposes only, and it is to be understood that changes and variations may be made without departing from the spirit and scope of the following claims.

What is claimed is:

1. An appliance for washing the lower parts of the human body, comprising:

a toilet bowel;

nozzle means having an outer nozzle provided with first holes and an inner nozzle provided with second holes, the inner nozzle being disposed within the outer nozzle; and rotating means for rotating the inner nozzle wherein the rotating means further comprises a stepper motor.

2. An appliance for washing the lower parts of the human body as set forth in claim 1, wherein the holes in the outer nozzle are long holes formed circumferentially.

3. An appliance for washing the lower parts of the human body as set forth in claim 2, wherein the number of the long holes is three.

4. An appliance for washing the lower parts of the human body as set forth in claim 1, wherein the second holes in the inner nozzle are round.

5. An appliance for washing the lower parts of the human body as set forth in claim 1, further comprising driving means for moving the outer nozzle axially forward and backward.

6. An appliance for washing the lower parts of the human body as set forth in claim 5, further comprising an electric motor, wherein the driving means further comprises a movable member mounted integrally with the outer nozzle and moved by said electric motor.

7. An appliance for washing the lower parts of the human body as set forth in claim 6, wherein the motor is a stepper motor.

* * * * *